United States Patent [19]

Mayer et al.

[11] 4,409,468

[45] Oct. 11, 1983

[54] METHOD FOR INDIRECTLY LAYING A WEAPON AND APPARATUS FOR THE PERFORMANCE OF THE METHOD

[75] Inventors: Cornelius Mayer, Fällanden; Jörg Durrer, Oberengstringen; Ronald Weber, Wettswil, all of Switzerland

[73] Assignee: Werkzeugmaschinenfabrik Oerlikon-Bührle AG, Zurich, Switzerland

[21] Appl. No.: 317,147

[22] Filed: Nov. 2, 1981

Related U.S. Application Data

[63] Continuation of Ser. No. 127,267, Mar. 5, 1980, abandoned.

[30] Foreign Application Priority Data

Mar. 23, 1979 [CH] Switzerland ..... 2738/79

[51] Int. Cl.[3] ..... F41G 3/14; F41G 5/14

[52] U.S. Cl. ..... 235/404; 89/41 E; 364/423

[58] Field of Search ..... 235/400, 404, 406, 411, 235/412, 413; 364/423; 89/41 E, 41 R, 41 L, 36 K

[56] References Cited

U.S. PATENT DOCUMENTS

| | | | |
|---|---|---|---|
| 2,363,173 | 11/1944 | Fuller | 235/406 X |
| 2,450,541 | 10/1948 | Chase et al. | 89/36 K |
| 2,578,666 | 12/1951 | Borden, Jr. | 89/41 R |
| 3,466,968 | 9/1969 | Stangl et al. | 89/41 E |
| 3,739,153 | 6/1973 | Kendy | 364/423 X |
| 3,881,824 | 5/1975 | Higgins | 235/404 |
| 4,172,409 | 10/1979 | Looss et al. | 364/423 |

FOREIGN PATENT DOCUMENTS

| | | |
|---|---|---|
| 1157509 | 6/1964 | Fed. Rep. of Germany . |
| 2360498 | 6/1975 | Fed. Rep. of Germany . |
| 1283078 | 12/1961 | France . |

*Primary Examiner*—Felix D. Gruber
*Attorney, Agent, or Firm*—Werner W. Kleeman

[57] ABSTRACT

For the indirect laying or aiming of a weapon at a target, which weapon is arranged upon a vehicle, there are performed with the aid of an electronic computer predetermined steps which enable the weapon to be layed rapidly, simply and in a fail-safe manner. The weapon is initially oriented with respect to the north direction. The target azimuth is stored in the computer. The computer shows the momentary direction deviation and the weapon is pivoted for such length of time until the display shows "O".

4 Claims, 5 Drawing Figures

METHOD FOR INDIRECTLY LAYING A WEAPON AND APPARATUS FOR THE PERFORMANCE OF THE METHOD

CROSS REFERENCE TO RELATED APPLICATION

This is a continuation application of our commonly assigned, copending U.S. application Ser. No. 06/127,267, filed Mar. 5, 1980 and now abandoned.

BACKGROUND OF THE INVENTION

The present invention relates to a new and improved method for the indirect laying or aiming of a weapon, arranged upon a vehicle, at a target with the aid of an electronic firing data computer, and furthermore, pertains to novel apparatus for the performance of the aforementioned method.

Heretofore known systems of this type, for instance as disclosed in German Patent Publication No. 2,311,962, are relatively complicated, and thus, on the one hand, are not easy to operate and, on the other hand, prone to malfunction. As experience has shown, with such systems the danger exists of carrying out false settings and false readings, especially if the operating crew is working under difficult conditions.

SUMMARY OF THE INVENTION

Therefore, with the foregoing in mind it is a primary object of the present invention to provide a new and improved method of, and apparatus for, indirectly laying or aiming of a weapon at a target in a manner not afflicted with the aforementioned shortcomings and drawbacks of the prior art discussed above.

Another and more specific object of the invention aims at appreciably simplifying the aiming apparatus of the invention in contrast to heretofore known equipment, in order to avoid errors which arise during the setting operation and in order to be able to lay the weapon as quickly as possible and in a foolproof or "fail-safe" manner.

Now in order to implement these and still further objects of the invention, which will become more readily apparent as the description proceeds, the inventive method for the indirect laying or aiming of a weapon, arranged upon a vehicle at a target with the aid of an electronic firing data computer, comprises the steps of:

1. Determining the orientation of the vehicle by:
   - 1.1 inputting to the computer a value representative of a predetermined orientation azimuth between a reference direction and an auxiliary direction given by an auxiliary target point;
   - 1.2 pivoting the weapon between the vehicle axis and the auxiliary direction and measuring the pivot angle ($\gamma$);
   - 1.3 subtracting by means of the computer the measured pivot angle ($\gamma$) from the inputted orientation azimuth and storing in the computer the vehicle azimuth obtained by the subtraction steps;
2. laying the weapon at the target by:
   - 2.1 infeeding to the computer a value representative of the predetermined target azimuth between the reference direction and the target direction;

- 2.2 computing the angle ($\beta$) between the target direction and the vehicle axis by means of the computer;
   - 2.3 displaying the sum of the computed angle ($\beta$) between the target direction and the vehicle axis and the angle between the present (momentary) position of the weapon and the vehicle axis; and
   - 2.4 pivoting the weapon out of the auxiliary direction to the target direction until the display shows the value null.

As already mentioned the invention is also concerned with apparatus for laying a weapon at a target with the aid of an electronic firing data computer, which apparatus comprises:

- a first selector switch for the input of the orientation azimuth;
- a second selector switch for the input of the target azimuth;
- a third selector switch for the input of elevation;
- a numerical display for indicating the lateral direction of the weapon;
- a numerical display for indicating the elevation of the weapon;
- a first code disk for azimuth; and
- a second code disk for elevation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
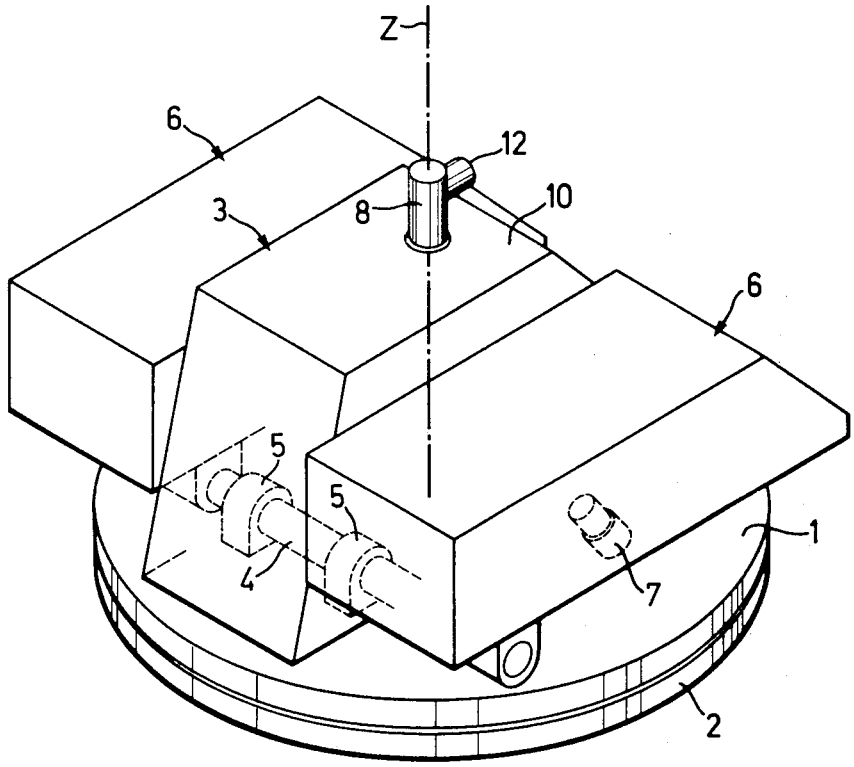
FIG. 1 is a perspective view illustrating a weapon system, here shown by way of example as a rocket launcher.

Describing now the drawings, according to the showing of FIG. 1 a suitable weapon system, here assumed to be a rocket weapon system is arranged upon a platform 1 which is rotatably mounted upon a ring or ring member 2 for rotation about a lateral aiming axis Z. The ring member 2 is attached to a combat vehicle which has not been particularly shown since the same forms no part of the invention and is totally unimportant for understanding the underlying principles of this development. Upon the platform 1 there is arranged an armored housing 3 which affords space in the form of an operating or combat chamber for the gunner. Located at the longitudinal central plane of the housing 3 is the traversing or lateral aiming axis Z. A trunnion 4, dispositioned perpendicular to the aforementioned longitudinal central plane, is rotatably mounted in two bearing or pillow blocks 5 secured to the platform 1. At both sides of the housing 3 there are arranged tube clusters, generally designated by reference character 6, of a rocket launcher, which are attached to the trunnions 4. For elevation of the merely schematically indicated but conventional launching tube cluster 6 of the rocket launchers there are provided spindles 7 or equivalent structure, by means of which they can be pivoted or rocked about the trunnions 4.

Figure 2:
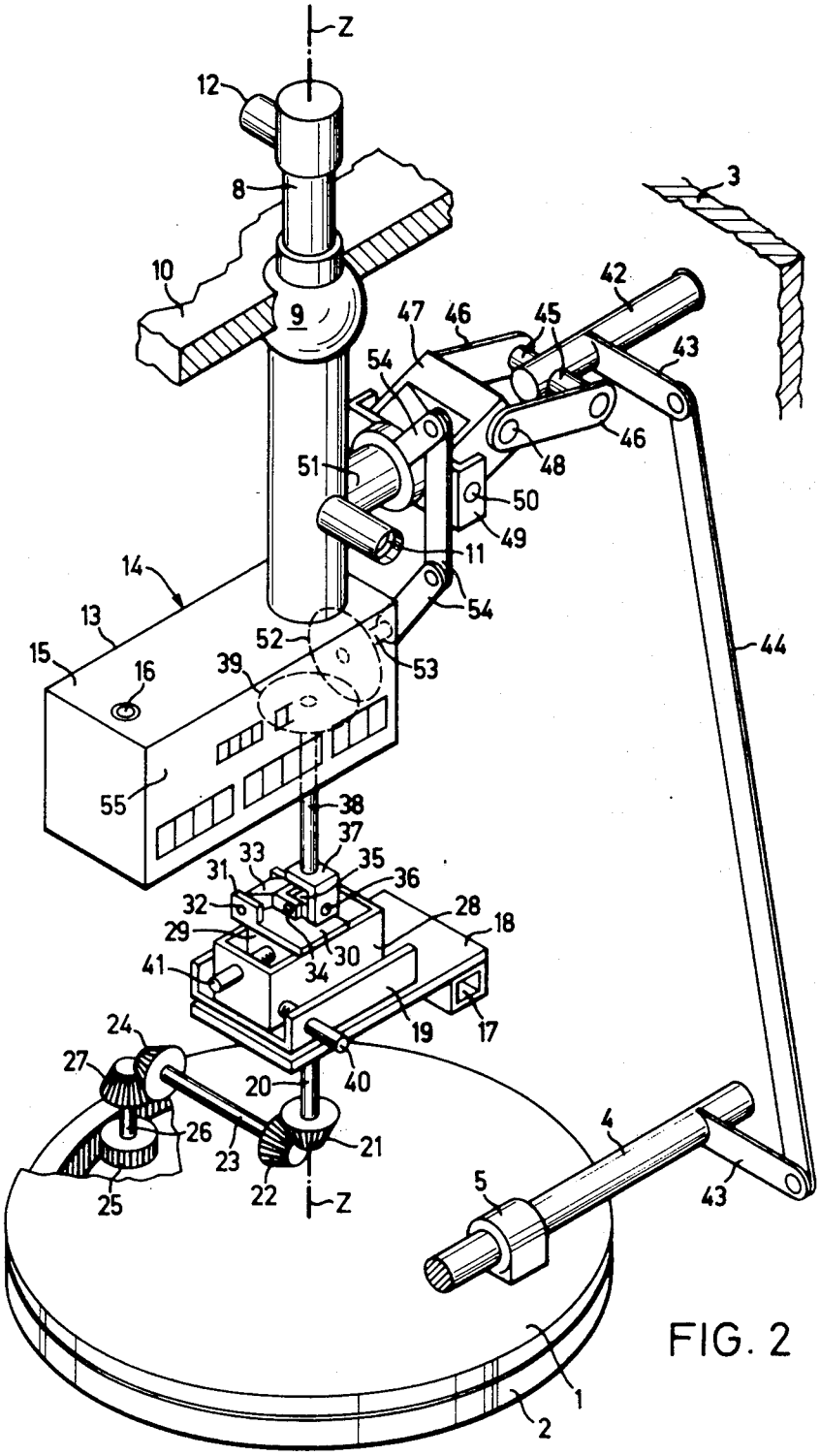
FIG. 2 is a perspective view showing the laying apparatus for the weapon system of FIG. 1.

Turning attention to FIG. 2, it will be noted that an aiming periscope 8 is mounted, with the aid of a ball-and-socket joint 9, so as to be pivotable at all sides in the cover or ceiling 10 of the housing 3. The center of the ball-and-socket joint 9 is located, on the one hand, at the optical axis of the aiming periscope or telescopic sight 8 and, on the other hand, at the traversing or lateral aiming or sighting axis Z of the weapon. The ocular or eyepiece 11 of the aiming or sighting periscope 8 is located internally of the housing 3 and the objective lens arrangement 12 of the aiming or sighting periscope 8 is located above the ceiling 10 of the housing 3. A housing 13 of an electronic computer 14 is attached to the lower end of the aiming periscope 8. A cover 15 of the housing 13 is located perpendicular to the optical axis of the aiming periscope 8 and contains a leveling indicator or box level 16.

Secured to the housing 3 is a support or carrier 17 upon which there is supported a table 18. Rotatably mounted upon the table 18 is a frame 19, at which there is attached a shaft 20. At the lower end of the shaft 20 there is secured a gear 21 which meshes with a second gear 22. The second gear 22 is connected by means of a horizontal shaft 23 with a third gear 24. This third gear 24 engages with a fourth gear 27, which is connected by means of a vertical shaft 26 with a fifth gear 25. This fifth gear 25 meshes with not particularly referenced internal teeth of a ring member or ring gear 2. Both of the shafts 23 and 26 are rotatably mounted in any suitable fashion upon the platform 1, typically in bearings.

Displaceably mounted in the frame or frame means 19 is a carriage or slide 28 for movement in a direction which is essentially perpendicular to the traversing or lateral aiming axis Z. The carriage 28 forms the guide for a second carriage or slide 29 movable in a direction which is oriented perpendicular both to the lateral aiming axis Z and also with respect to the direction of movement of the carriage or slide 28. Two threaded spindles 40 and 41 or equivalent structure are mounted, on the one hand, in the frame 19 and, on the other hand, in the carriage or slide 28 and serve for the displacement of both carriages or slides 28 and 29 which collectively form a cross-table. At the carriage 29 there is attached a support or carrier 30 having two side plates or cheeks 31 which carries a shaft 32 oriented essentially perpendicular to the shaft 20. Pivotable about the shaft 32 is a pivot element 33 having a forked or bifurcated end, which is hingedly connected by means of a shaft 34 with a second pivot or hinge element 35. The shaft 34 is directed essentially parallel to the shaft 32 and perpendicular to a further shaft 36 which is attached at the pivot or hinge element 35. Pivotable about the shaft 36 is a third pivot or hinge element 37 which is connected with a shaft 38 mounted in the housing 13 of the firing data computer 14 and carries at its upper end a coding disk 39. The shaft 38 is arranged coaxially with respect to the optical axis of the aiming periscope 8. The shafts 34, 36 and 38 intersect at a point.

When the combat vehicle is horizontally disposed or level and the weapon is lashed or tied at the vehicle, i.e. when the weapon axis is oriented parallel to the vehicle axis, then the coding disk 39 is located in its starting position.

Rotatably mounted in a side wall of the housing 3 is a shaft 42 in a position parallel to the trunnions 4. At the shaft 42 and at the trunnions 4 there is secured a respective arm 43 and both of the arms 43 are interconnected with one another by means of a rod or link 44. The arms 43 extend essentially parallel to one another and their effective portions are of the same length. At the shaft 42 there are attached two axle journals 45, whose common axis intersects at right angles the axis of the shaft 42 and is located in a plane directed perpendicular to the optical axis of the aiming periscope 8. At each of both axle journals 45 there is hingedly connected the respective end of a forked or bifurcated member 46, whose other ends are attached to a shaft 48 of a pivot or hinge element 47. The pivot element 47 is pivotable about a shaft 50 which is mounted in a support or carrier 49. Both of the shafts 48 and 50 are arranged parallel to the axle journals 45. The support 49 is rotatably mounted upon a connection element 51. The axis of rotation of the support 49 intersects the optical axis of the aiming periscope 8 and is directed perpendicular thereto. Within the housing 13 of the computer 14 there is attached a coding or disk 52 at a shaft 53 which is mounted within housing 13, this shaft 53 extending parallel to the connection element or piece 51. The shaft 53 is in driving connection with the support or carrier 49 by means of a parallelogram rod arrangement 54.

Figure 5:
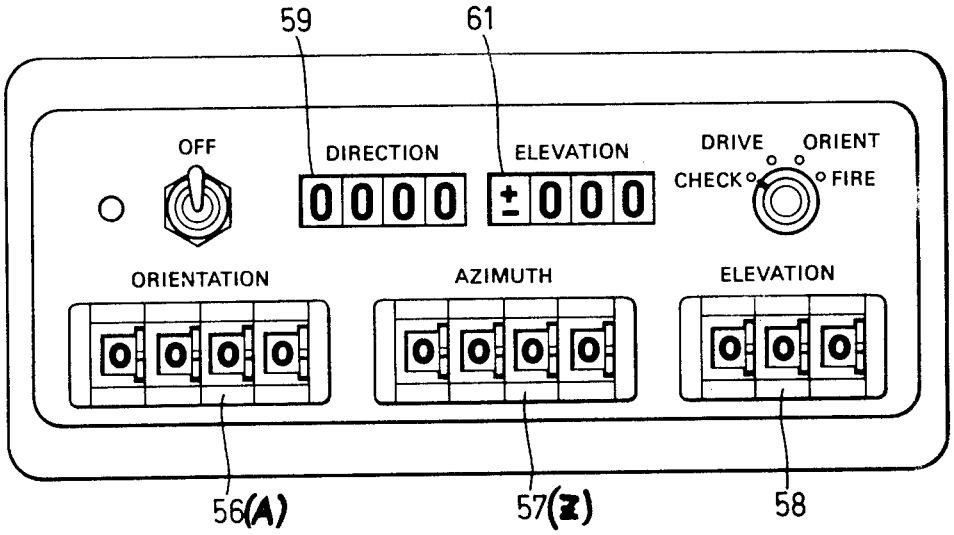
FIG. 5 is a front view of the switching panel of the electronic firing computer showing the arrangement of the operating and display elements.

As best seen by referring to FIGS. 2 and 5, a wall 55 of the computer housing 13 is equipped with five windows or viewing fields, generally indicated by reference characters 80, 81, 82, 83 and 84. In the three lower windows 80, 81 and 82 there are arranged conventional thumbwheel or selector switches 56, 57 and 58, respectively. Each of these selector switches 56, 57 and 58 contains four manually indexable or adjustable numerical wheels or rolls which protrude outwardly through the related window. In both upper windows 83 and 84 there are displayed or indicated the direction or azimuth angle, generally indicated by reference character 59 and elevation angle or elevation, generally indicated by reference character 61, of the launching tube cluster 6 by luminescent numerals or displays.

Figure 3:
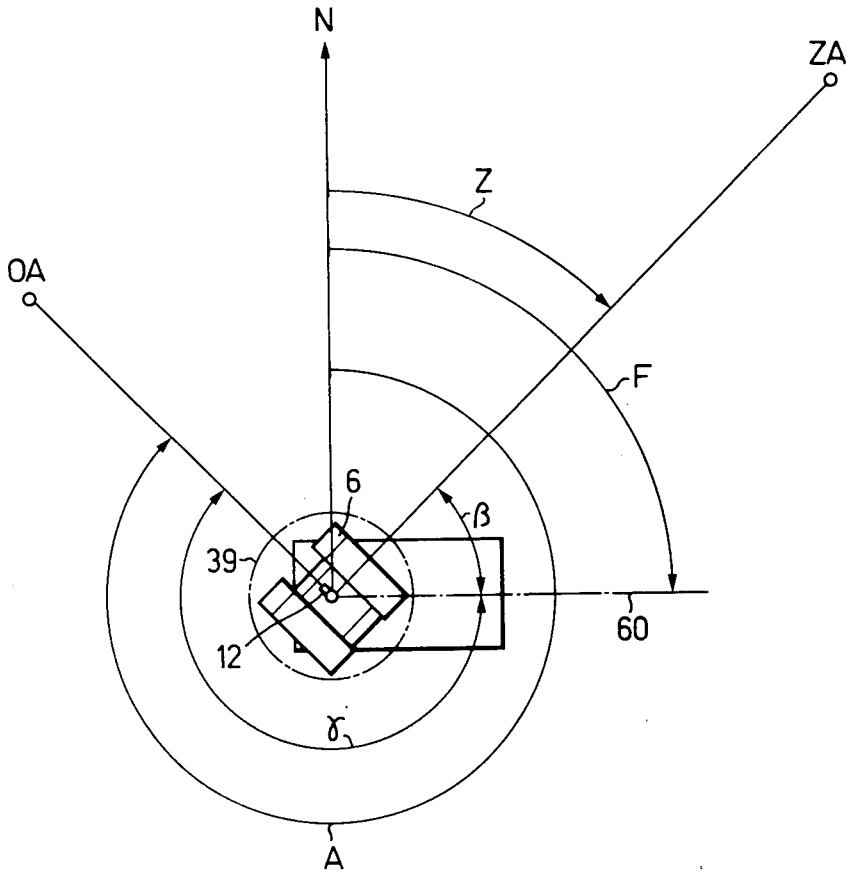
FIG. 3 illustrates the goniometric correlations during the autonomous laying or aiming of the weapon.
Figure 4:
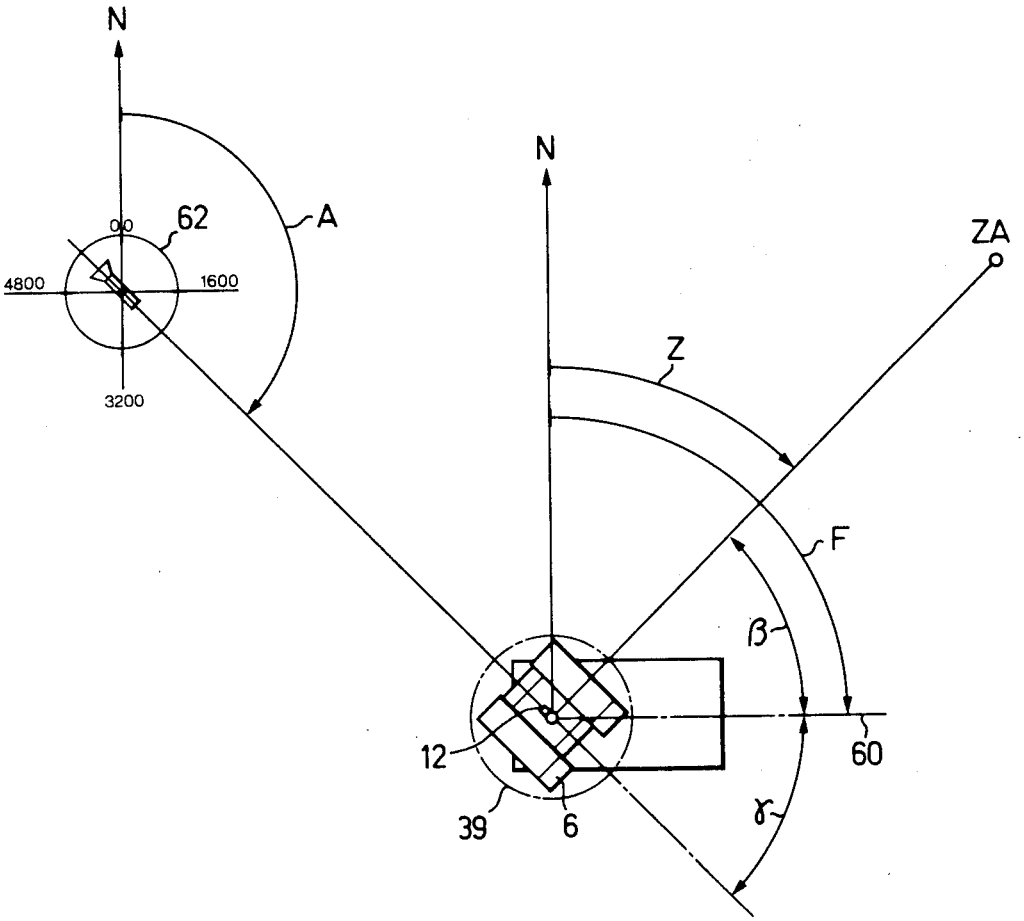
FIG. 4 is an illustration, corresponding to the showing of FIG. 3, for the laying of the weapon with an aiming circle.

According to the illustration of FIGS. 3 and 4 the following angles are of significance:

1. The azimuth is the angle, measured in clockwise direction and expressed in artillery mils0-6400 between the north direction and a further direction.
2. The vehicle azimuth F is the angle between the north direction N and the vehicle axis 60.
3. The launcher azimuth is the angle between the launcher or tube cluster 6 and the north direction N.
4. The target azimuth Z is the angle between the north direction N and the target direction ZA.
5. The orientation azimuth A is the angle between the north direction N and an auxiliary target point or orientation point OA.
6. The encoder azimuth $\beta$ is the angle between the vehicle axis 60 and the launcher or tube cluster axis.
7. The indicator azimuth is the azimuth displayed in the window 83, i.e. the direction 59.

The mode of operation of the described apparatus is as follows:

1. For the indirect laying or aiming of the weapon with the aid of a topographical card, there is initially vertically oriented the optical axis of the aiming periscope 8. This is accomplished in that with the aid of the threaded spindles 40 and 41 both of the carriages 28 and 29 of the cross-table are shifted until the levelling indicator or device 16 indicates the vertical position, and the aiming periscope 8 is pivoted about the center of the hinge or ball-and-socket joint 9.

2. At the aforementioned topographical card there is measured the orientation azimuth A (FIG. 3). The angle A, measured in clockwise direction in artillery mils, between the card north direction N and the connection line between the auxiliary target point OA and the weapon site is set at the switch means 56 of the computer 14, which switch means or indexable switch 56 has been labelled by the designation "Orientation".

3. The weapon is pivoted about the lateral or traversing aiming axis Z through the angle $\gamma$ out of its lashed or tied position i.e. out of the direction of the vehicle axis 60 into the direction of the auxiliary target point OA. As auxiliary target points there can be employed objects which, on the one hand, can be clearly recognized or detected by means of the aiming or sighting periscope 8, and therefore, can be easily sighted or aimed at and, on the other hand, can be easily determined from the topographical card. Also the topographical card must enable unambiguously determining the weapon site. Preferably there should be used such auxiliary target points which are located at least approximately five kilometers from the weapon site, such as for instance trigonometric signals of the terrain measurement, church towers, mountain peaks and so forth.

During pivoting of the weapon the spur gear 25 is rolled upon the toothed rim of the ring member 2 and therefore rotates, by means of the shaft 26, the gears 27, 24, the shaft 23, the gears 22, 21 and the shaft 20, the frame or frame means 19 in relation to the table 18 through the negative angle $\gamma$, whereas the weapon is pivoted through the positive angle $\gamma$. Hence, the pivot angles through which the frame means 19 along with the cross-table 28, 29 carried thereby and the weapon simultaneously move are of the same magnitude but opposite in direction, and thus, the shaft 38 together with the encoding or coding disk 39 do not change their position in relation to the north direction N during the rotation of the weapon. On the other hand, the housing 13 of the computer 14 is co-rotated during the pivoting of the weapon about the traversing or lateral aiming axis Z and therefore changes its position, in relation to the coding disk 39, by the angle $\gamma$. This angle $\gamma$ is photoelectrically scanned at the coding disk 39 and infed to the computer 14.

4. The computer 14 now subtracts the pivot angle $\gamma$ described in rubric 3 from the orientation angle A described above in rubric 2. This difference $A-\gamma$ of both angles A and $\gamma$, according to the showing of FIG. 3, constitutes the vehicle azimuth F, i.e. the angle between the north direction N and the vehicle axis 60. This angle F is stored in the computer 14.

5. At the topographical card there is measured the angle Z between the card north direction N and the connection line between the target point ZA and the weapon site, i.e. there is determined the target azimuth and such is manually set at the selector switch 57 of the comparator 14, which switch has been labelled by the designation "Azimuth" in FIG. 5.

6. The computer 14 is now capable of computing the angle $\beta$ (see FIG. 3) from the target azimuth F stored in accordance with the description appearing in rubric 4 and the target azimuth Z which has been set in accordance with the description given above in rubric or paragraph 5.

7. At the display window 83 there appears the angle $\beta+\gamma$, i.e. there is indicated the angle through which the weapon deviates from the desired target direction.

8. The weapon is rotated in the counter clockwise direction for such length of time until there appears in the display or indicator window 83 the value "0", and hence the weapon now is directed in lateral direction at the target.

9. The elevation angle of the launching tube cluster 6, required for combating a target, is set at the selector switch 58 which has been labelled with the legend "Elevation". When the launching tube cluster 6 is horizontally dispositioned, then there is read at the coding disk 52 the value null, by means of a scanning device of the computer 14, and at the display or indicator window 84 there appears the elevation angle.

10. The launching tube cluster 6 now must be pivoted for such length of time until there appears in the display or indicator window 84 the value "0", and thus the weapon also is aimed upon the target in elevation.

A pivoting of the launching tube cluster 6 about the axis of the trunnions 4 is transmitted by means of the parallelogram rod arrangement 43, 44 to the shaft 42 and by means of the latter, via the brackets 46 of the pivot element 47, the support 49 and the connection element 51, to the parallelogram rod arrangement or parallelogram rod means 54, by means of which the coding disk 52 is driven. During the movement of the launching tube cluster 6 in the target elevation the computer 14 determines the momentary elevation angle, i.e. the actual values are continuously infed by the scanning device, the difference between the set reference value and the continuously changing actual value of the launching tube cluster 6, and the computer displays such value at the display or indicator window 84 as the elevation value 61. As stated, when there appears the difference "0" the weapon is aimed or layed at the target.

With the weapon canted or non-level, i.e. when the elevation axis or axis of the trunnions 4 is inclined with respect to the horizontal, then in conventional manner during elevation of the launching tube cluster 6 the aiming periscope or sighting telescope 8, and thus also the housing 13 of the computer 14, is rotated about its axis, so that in the display or indicator window 83 there appears a value which differs from null. Since the shaft 42 is parallel to the inclined elevation axis, the plane in which the axle journal 45 moves during the weapon elevation, is inclined with respect to the vertical axis of the aiming periscope 8. The bifurcated or forked member 46, connected with the axle journals 45, produce by means of the pivot or hinge element 47 and the support 49 a rotational movement of the aiming periscope 8 about its axis. Thereafter the weapon must again be pivoted about the lateral aiming axis Z, until the displayed deviation of the azimuth disappears.

In order to aim or lay the weapon by means of an oriented aiming circle 62, according to FIG. 4, the objective lens system 12 of the aiming periscope 8 must be pivoted through 180°. The aiming circle 62 therefore together with the aiming periscope 8 is aimed in a direction opposite to the firing direction of the launching tube cluster or launching tube means 6. The orientation azimuth A is read at the aiming circle 62 and transmitted to the occupants of the combat turret or area of the combat vehicle. Aiming with the aid of the computer 14 otherwise is accomplished in exactly the same manner as previously explained during the aiming operation performed with the aid of an auxiliary target point OA.

While there are shown and described present preferred embodiments of the invention, it is to be distinctly understood that the invention is not limited thereto, but may be otherwise variously embodied and practiced within the scope of the following claims. Accordingly,

What we claim is:

1. A method for the indirect laying of a weapon, arranged upon a vehicle, at a target with the aid of an electronic computer having a display, comprising the steps of:

1. determining the orientation of the vehicle by:
   1.1. inputting to the computer a value representative of a predetermined orientation azimuth (A) between a reference direction (N) and an auxiliary direction (OA) given by an auxiliary target point;
   1.2. pivoting the weapon between the vehicle axis (60) and the auxiliary direction (OA) and measuring by means of a code disk (39) the pivot angle ($\gamma$);
   1.3. computing the vehicle azimuth by means of the computer from the inputted orientation azimuth (A) and the measured pivot angle ($\gamma$) and storing said vehicle azimuth ($F=A-\gamma$) obtained by the computing step;
2. laying the weapon at the target by:
   2.1. infeeding to the computer a value representative of the predetermined target azimuth (Z) between the reference direction (N) and the target direction (ZA);
   2.2. computing the angle ($\beta=F-Z$) between the target direction (ZA) and the vehicle axis (60) from the inputted target azimuth (Z) and from the computed vehicle azimuth (F) by means of the computer;
   2.3. displaying the angle ($\beta+\gamma'$) between the target direction (ZA) and the present (momentary) position of the weapon composed of the angle between the target direction and the vehicle axis and the angle between the present (momentary) position of the weapon and the vehicle axis; and
   2.4. pivoting the weapon out of the auxiliary direction (OA) to the target direction (ZA) until the display shows the value null.

2. An apparatus for laying a weapon at a target with the aid of an electronic firing data computer, comprising:

an electronic firing data computer;

a first selector switch for inputting a value representative of an orientation azimuth to the firing computer;

a second selector switch for inputting a value representative of target azimuth to the firing data computer;

a third selector switch for inputting a value representative of elevation to the firing data computer;

a numerical display cooperating with said firing data computer for indicating the lateral direction of the weapon;

a numerical display cooperating with said firing data computer for indicating the elevation of the weapon;

a first code disk for azimuth for inputting to the firing data computer a value representative of a predetermined azimuth; and a second code disk for elevation for inputting to the computer a value representative of the effective elevation angle of the weapon.

3. A method for indirect laying of a weapon, arranged upon a vehicle, at a target with the aid of an electronic firing data computer having a display, comprising the steps of:

inputting to the computer a value representative of the angle A between a reference direction N and an auxiliary direction OA;

inputting to the computer a value representative of the angle Z between said reference direction N and the target direction ZA;

inputting to the computer a value representative of the elevation angle of the target;

directing the weapon in said auxiliary direction OA;

directing the weapon to the horizon;

after these acts are performed by a human operator automatically performing by means of the computer the following steps:

displaying at a first numerical display for indicating the lateral direction of the weapon a value representative of the angle between the effective lateral direction of the weapon and the target direction;

displaying at a second numerical display for indicating the elevation of the weapon a value representative of the difference between the effective elevation angle of the weapon and the elevation angle of the target; and directing the weapon at the target until the first and second numerical displays each display the value null.

4. An apparatus for indirect laying a weapon arranged upon a vehicle at a target with the aid of an electronic firing data computer having a display, comprising:

a first selector switch for inputting to the computer a value representative of an orientation azimuth angle A measured between a reference direction N and an auxiliary direction OA;

a second selector switch for inputting to the computer a value representative of a target azimuth angle Z measured between said reference direction N and the target direction ZA;

a third selector switch for inputting to the computer a value representative of a target elevation angle;

an azimuth code disk for inputting to the computer a value representative of the angle between the auxiliary direction OA and the effective direction of the weapon;

an elevation code disk for inputting to the computer a value representative of the effective elevation angle of the weapon;

a first numerical display cooperating with said computer for indicating the angle between the effective lateral direction of the weapon and the target direction ZA; and a second numerical display cooperating with said computer for indicating the difference between the effective elevation angle of the weapon and the target elevation angle.

* * * * *